United States Patent [19]

Howe et al.

[11] Patent Number: 4,731,636

[45] Date of Patent: Mar. 15, 1988

[54] LIQUID CARRIER RECOVERY SYSTEM

[75] Inventors: William C. Howe, Walworth, N.Y.; Thomas C. Hsu, Reading, Mass.

[73] Assignee: Xerox Corporation, Stamford, Conn.

[21] Appl. No.: 23,315

[22] Filed: Mar. 9, 1987

[51] Int. Cl.[4] ..... G03G 15/10; G03G 15/20

[52] U.S. Cl. ..... 355/10; 355/3 FU; 355/14 FU

[58] Field of Search ..... 355/3 FU, 14 FU, 3 R, 355/3 TR, 14 R, 14 TR; 219/216; 432/60; 55/266, 265, 97, 309, 312, 313, 314

[56] References Cited

U.S. PATENT DOCUMENTS

| | | | |
|---|---|---|---|
| 3,330,189 | 7/1967 | Vil | 95/1.7 |
| 3,740,867 | 6/1973 | Hamaguchi | 34/95 |
| 3,827,855 | 8/1974 | Blake | 432/60 |
| 3,857,189 | 12/1974 | Katayama et al. | 34/95 |
| 3,893,800 | 7/1975 | Wako | 432/60 |
| 3,902,845 | 9/1978 | Murphy | 432/60 |
| 4,059,394 | 11/1977 | Ariyama et al. | 432/59 |
| 4,087,676 | 5/1978 | Kukase | 219/216 |
| 4,172,975 | 10/1979 | Nado | 219/216 |
| 4,252,546 | 2/1981 | Krugmann | 55/82 |
| 4,384,783 | 5/1983 | Sakata et al. | 355/3 FU |
| 4,415,533 | 11/1983 | Kurotori et al. | 355/10 X |
| 4,462,675 | 7/1984 | Moran et al. | 355/10 X |
| 4,487,616 | 12/1984 | Grossman | 55/85 |
| 4,520,048 | 5/1985 | Ranger | 427/350 |
| 4,538,899 | 9/1985 | Landa et al. | 355/10 |
| 4,541,707 | 9/1985 | Yoshinage | 355/3 FU |
| 4,546,671 | 10/1985 | Anderson | 355/3 SH |
| 4,595,274 | 6/1986 | Sakurai | 355/3 FU |
| 4,687,319 | 8/1987 | Mishra | 355/10 |

FOREIGN PATENT DOCUMENTS

| | | |
|---|---|---|
| 156046 | 2/1985 | European Pat. Off. . |
| 1436571 | 5/1976 | United Kingdom . |

*Primary Examiner*—A. C. Prescott

*Attorney, Agent, or Firm*—H. Fleischer; J. E. Beck; R. Zibelli

[57] ABSTRACT

An apparatus in which a developing liquid used in an electrophotographic printing machine to develop an electrostatic latent image on a photoconductive surface is reclaimed. The developing liquid is vaporized to dry the wet copy sheet. The developing liquid vapor enters the chamber of a housing and condenses on the surface of a cooling fluid as it passes therethrough. The developer liquid is immiscible in the cooling fluid and floats on the surface thereof so as to exit from the outlet port of the chamber of the housing for recirculation to the development system.

11 Claims, 2 Drawing Figures

LIQUID CARRIER RECOVERY SYSTEM

Figure 1:
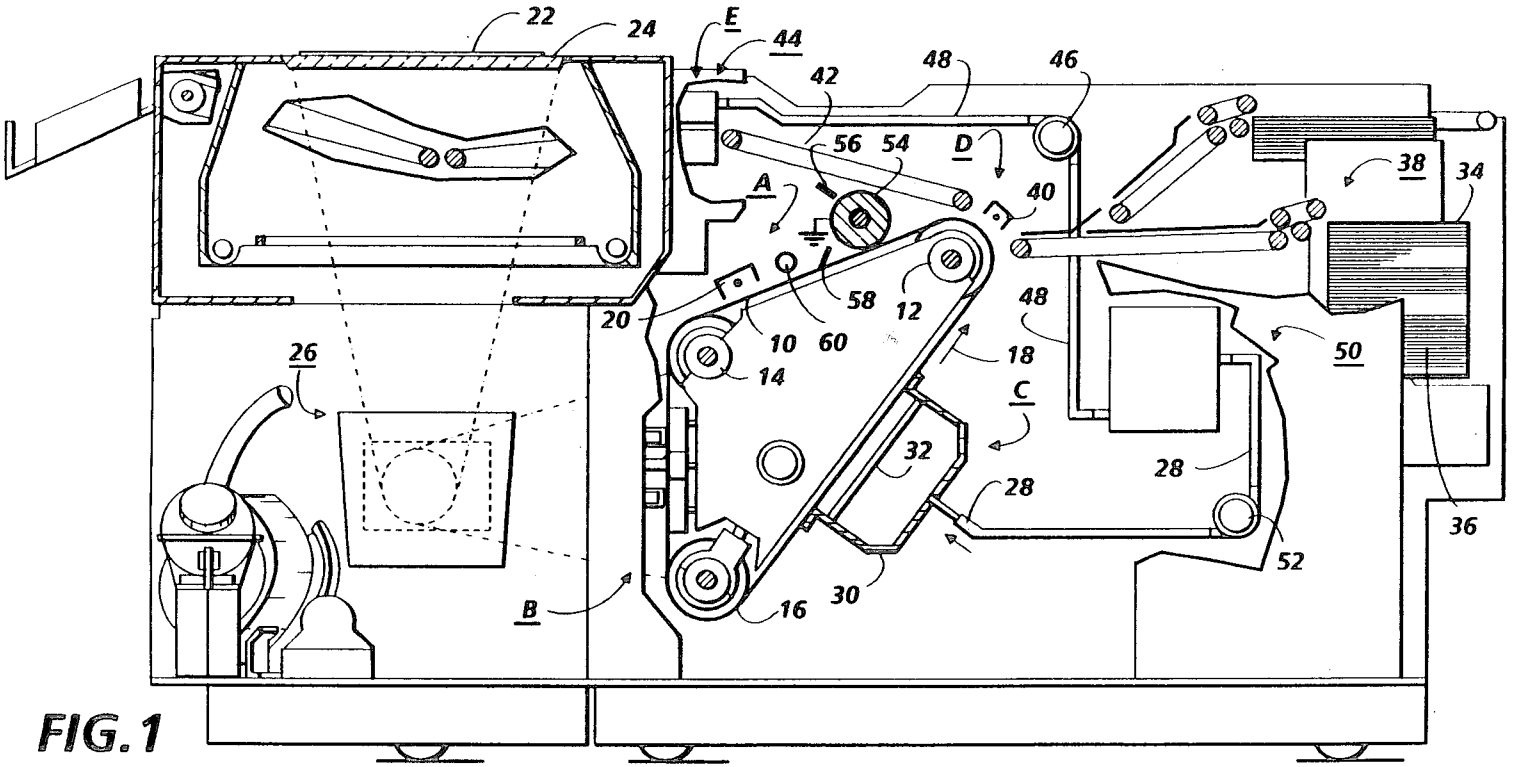

This invention relates generally to an electrophotographic printing machine, and more particularly concerns an apparatus for reclaiming a developing liquid.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained in the original document. After the electrostatic latent image is recorded on the photoconductive member, the latent image is developed by bringing a developer material into contact therewith. In a wet type of development system, a developing liquid composed of a liquid carrier with toner particles dispersed therein wets the photoconductive surface to form a visible image thereon. The visible image on the photoconductive member is transferred to the copy sheet. The copy sheet is now wet having both liquid carrier and toner particles thereon. At this time, the copy sheet passes through a fixing/drying device where the residual liquid carrier is vaporized and the toner particles permanently fused to the copy sheet, in image configuration. Hereinbefore, the vaporized liquid carrier was expelled to the atmosphere. This resulted in pollution of the atmosphere. In relatively low volume copying machines having only periodic use, this type of pollution was not very significant. However, with the advent of high volume copying machine, the problem of pollution from vaporized liquid carrier is aggravated. Some of the suggested techniques for solving this problem, such as venting the vaporized liquid carrier to the open atmosphere or burning it in a closed chamber, are either impractical or not very cost effective. For example, the cost of plumping in a corporate office to vent the vaporized liquid carrier into the open atmosphere would be exorbitant. The signifcance of this pollution may be readily understood by the fact that a copying machine capable of making 10,000 copies per day will yield about 1.6 kilograms of vaporized liquid carrier. This pollution makes any area wherein the copying machine is located intolerable to human operators. Furthermore, the replacement of this amount of used developer liquid with new developer liquid increases the operating cost of the printing machine. Preferably, the used developer liquid should be reclaimed for subsequent reuse so as to minimize the amount of new developer liquid required. In order to provide a solution to this problem, it has been recommended that the vaporized liquid carrier by condensed and recovered for subsequent reuse within the printing machine. Various techniques have been devised for achieving the foregoing. The following disclosures appear to be relevant:

U.S. Pat. No. 4,252,546
Patentee: Krugmann
Issued; Feb. 24, 1981
U.S. Pat. No. 4,487,616
Patentee: Grossman
Issued: Dec. 11, 1984

The relevant portions of the foregoing disclosures may be briefly summarized as follows:

Krugmann discloses a process and apparatus for the recovery of a solvent from an exhaust air of a dry cleaning machine. The exhaust air is passed through a liquid solvent bath causing the solvent and aqueous moisture in the exhaust gas to condense. The condensed vapor freezes and forms floating ice crystals which, along with the excess solvent, are removed from the top of the liquid solvent bath and decanted.

Grossman describes a method for removing a solvent from solvent vapor laden air exiting a dry cleaning machine. Solvent laden air is moved through a first chamber and brought into contact with a film of liquid coolant whereby the coolant is immiscible with the solvent to be recovered. The solvent is condensed on the liquid film and the immiscible liquid coolant and condensed solvent are collected and then separated.

In accordance with one aspect of the present invention, there is provided an apparatus for reclaiming a developing liquid. The apparatus includes a housing defining a chamber having inlet and outlet ports. A developing liquid vapor enters the chamber through the inlet port and developing liquid exits the chamber through the outlet port thereof. A cooling fluid is located in the chamber of the housing. The developer liquid is immiscible in the the cooling fluid. As the developer vapor passes from the inlet port through the cooling fluid to the surface thereof, it condenses and exits the chamber of the housing from the exit port.

Pursuant to another aspect of the present invention, there is provided an electrophotographic printing machine of the type in which an electrostatic latent image is recorded on a photoconductive surface. Means develop the electrostatic latent image with developing liquid in image configuration. Means transfer the liquid image from the photoconductive surface to a copy sheet. Means are provided for vaporizing the developing liquid to dry the copy sheet wet with developing liquid. A housing, defining a chamber having an inlet port in communication with the vaporizing means and an outlet port, is provided so that the developed liquid vapor enters the chamber through the inlet port and developing liquid exits the chamber through the outlet port thereof. A cooling fluid is located in the chamber of the housing. The developer liquid is immiscible in the the cooling fluid. As the developer vapor passes from the inlet port through the cooling fluid to the surface thereof, it condenses and exits the chamber of the housing from the exit port.

Figure 2:
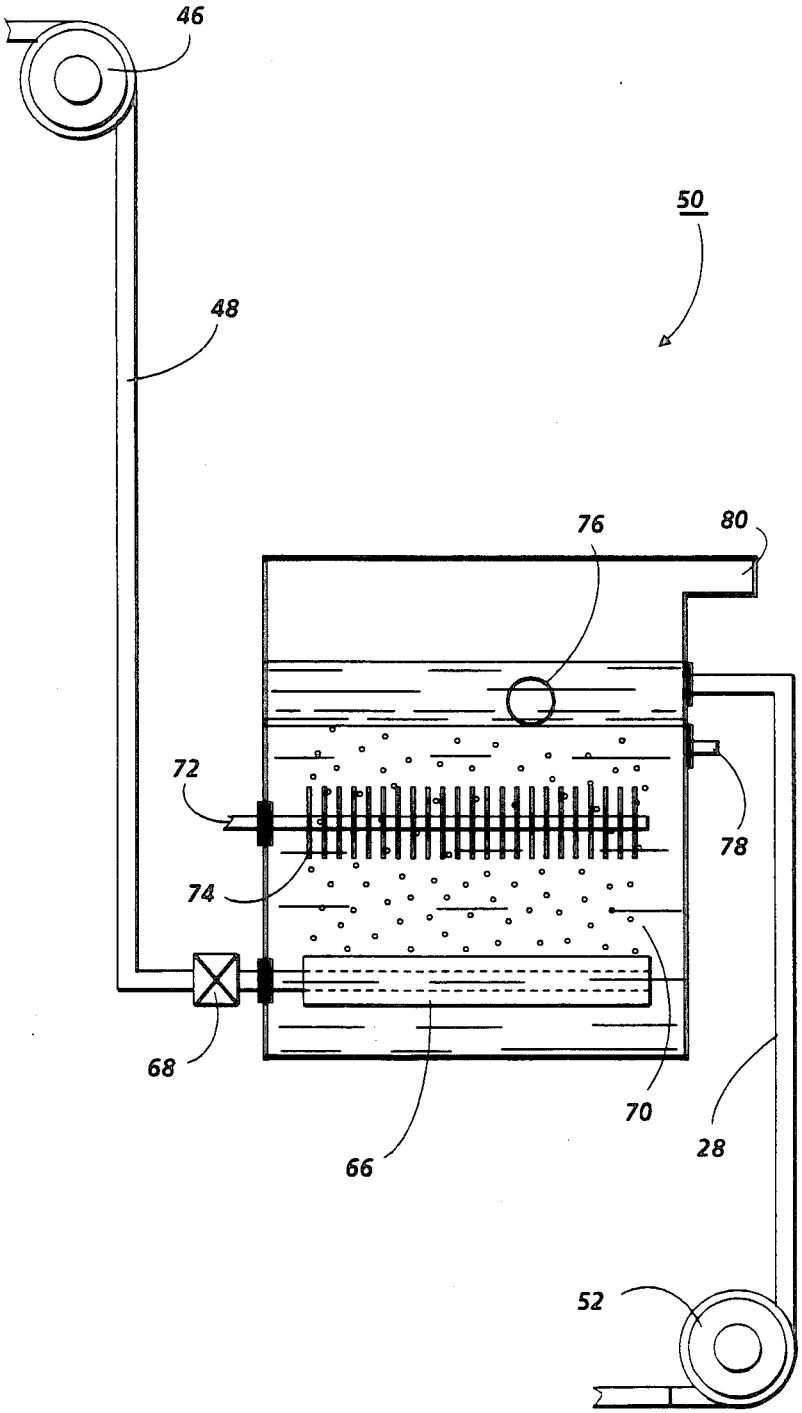

Other features of the present invention will become apparent as the following description proceeds and upon reference to the drawings, in which:

FIG. 1 is a schematic, elevational view of an electrophotographic printing machine incorporating the features of the present invention therein; and FIG. 2 is a schematic elevational view of the developer liquid recovery system employed in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. FIG. 1 is a schematic elevational view illustrating an electrophotographic printing machine incorporating the features of the present invention therein. It will become apparent from the following discussion, that the apparatus of the present invention is equally well suited for use in a wide variety of printing machines and is not necessarily limited in its application to the particular embodiment shown herein.

Turning now to FIG. 1, the printing machine employs a belt 10 having a photoconductive surface deposited on a conductive substrate. Preferably, the photoconductive surface is made from a selenium alloy with the conductive substrate being made preferably from an aluminum alloy which is electrically grounded. Belt 10 advances successive portions of the photoconductive surface sequentially through the various processing stations disposed about the path of movement thereof. The support assembly for belt 10 includes three rollers, 12, 14 and 16 located with parallel axes at approximately the apexes of a triangle. Roll 12 is rotatably driven by a suitable motor and drive (not shown) so as to rotate and advance belt 10 in the direction of arrow 18.

Initially, belt 10 passes through charging station A. At charging station A, a corona generating device 20 charges the photoconductive surface of belt 10 to a relatively high, substantially uniform potential.

After the photoconductive surface of belt 10 is charged, the charged portion thereof is advanced to exposure station B. At exposure station B, an original document 22 is placed face down upon a transparent support platen 24. An exposure assembly, indicated generally by the reference numeral 26, illuminates the original document 22 on platen 24 to produce image rays corresponding to the informational areas of the original document. The image rays are projected by means of an optical system onto the charged portion of the photoconductive surface. The light image dissipates the charge in selected areas to record an electrostatic latent image on the photoconductive surface corresponding to the informational areas contained within original document 22.

After the electrostatic latent image has been recorded on the photoconductive surface of belt 10, belt 10 advances the electrostatic latent image to development station C. At development station C, a developing liquid, comprising at least an insulating carrier liquid and toner particles, i.e., pigmented marking particles, is circulated through pipe 28 into development tray 30. Development electrode 32, which may be appropriately electrically biased, assists in depositing toner particles on the electrostatic latent image as it passes in contact with the developing fluid. The charged toner particles, disseminated through the carrier liquid, pass, by electrophoresis, to the electrostatic latent image. The charge of the toner particles is opposite in polarity to the charge on the photoconductive surface. For example, if the photoconductive surface is made from a selenium alloy, the corona charge will be positive and the toner particles will be negatively charged. Alternatively, if the photoconductive surface is made from a cadmium sulfide material, the charge will be negative and the toner particles will have a positive charge. Normally, the amount of liquid on the photoconductive surface is excessive. Accordingly, a roller (not shown) whose surface moves in a direction opposite to the direction of movement of belt 10 is spaced from the photoconductive surface and adapted to shear excessive liquid from the developed image without disturbing the image. A suitable developer material is described in U.S. Pat. No. 4,582,774 issued to Landa in 1986, the relevant portions thereof being hereby incorporated into the present application. By way of example, the insulating carrier liquid may comprise at least a hydrocarbon liquid, although other insulating liquids may also be employed. A suitable hydrocarbon liquid is an Isopar, which is a trademark of the Exxon Corporation. These are branched aliphatic hydrocarbon liquids (largely decane). The toner particles comprise at least a binder and pigment. The pigment may be carbon black. However, one skilled in the art will appreciate that any suitable liquid developer material may be employed. The liquid developer material is reclaimed and recirculated to development tray 30. The arrangement for reclamation of the liquid developer material will be described hereinafter with reference to the fusing and drying stations employed in the printing machine.

With continued reference to FIG. 1, after the electrostatic latent image is developed, belt 10 advances the developed image to transfer station D. At transfer station D, a sheet of support material 34 is advanced from stack 36 by a sheet transport mechanism indicated generally by the reference numeral 38. Transfer station D includes a corona generating device 40 which sprays ions onto the backside of the sheet of support material 34. This attracts the developed image from the photoconductive surface of belt 10 to copy sheet 34. Ideally, only the toner particles will be transferred to the copy sheet. However, in actuality, a portion of the carrier liquid as well as the toner particles are transferred to the copy sheet. Thus, the copy sheet is in a wet condition as it advances from transfer station D to fusing station E. Conveyor belt 42 is adapted to move the sheet of support material, i.e. the copy sheet to fusing station E.

Fusing and drying station E includes a fuser assembly, indicated generally by the reference numeral 44, which permanently fuses the developed image to the copy sheet. In addition, the fusing assembly vaporizes the liquid carrier adhering to the copy sheet. Fusing assembly 44 includes a heated fuser roller and back-up or pressure roll resiliently urged into engagement therewith to form a nip through which the copy sheet passes. A vacuum pump 46, associated with the housing of fusing and drying station 44, draws the vaporized liquid carrier through pipe 48 into a developer liquid recovery apparatus, indicated generally by the reference numeral 50. Recovery apparatus 50 condenses the vaporized liquid carrier. The liquid carrier is then pumped by pump 52 through pipe 28 back into tray 30 of development station C for subsequent reuse. The detailed structure of recovery apparatus 50 will be described hereinafter with reference to FIG. 2.

After the developed image is transferred to the sheet of support material, residual liquid developer material remains adhering to the photoconductive surface of belt 10. A cleaning roller 54 formed of any appropriate synthetic resin, is driven in a direction opposite to the direction of movement of belt 10 to scrub the photoconductive surface clean. To assist in this cleaning action, developing liquid may be fed through pipe 56 to the surface of cleaning roller 54. A wiper blade 58 completes the cleaning of the photoconductive surface. Any residual charge left on the photoconductive surface is extinguished by flooding the photoconductive surface with light from lamp 60.

Referring now to FIG. 2, there is shown the detailed structure of recovery apparatus 50. Recovery apparatus 50 includes a housing 62 defining a chamber 64. Pipe 48 is connected to housing 62 permitting vaporized liquid carrier to enter into aerator 66 in chamber 64. Preferably, aearator 66 is a porous stone having high pressure air pumped therein. The portion of pipe 48 extending into aerator 66 is preferably metal having perforations therein so as to make it porous. Valve 68 is located in pipe 48 to prevent the back flow of cooling fluid 70 from chamber 64. Liquid carrier is immiscible in cooling fluid 70. Pipe 72 has fins extending outwardly therefrom and is located in the cooling fluid 70 disposed in chamber 64 of housing 62. A refrigerant, e.g. Freon, is pumped into pipe 72 to cool cooling fluid 70. Preferably, cooling fluid 70 is water. The water is cooled sufficiently to cause the liquid carrier vapors to condense as it passes therethrough. The condensed liquid carrier floats to the surface of the water 70. The water temperature is maintained above 32° F. to prevent the freezing and the formation of ice. Thus, the liquid carrier vapors bubble through the water and condense as they pass therethrough to float on the surface of the water as a liquid. Pump 52 draws the liquid carrier into 28 from the surface of water 70 in chamber 64 of housing 62. The liquid carrier is pumped from chamber 64 of housing 62 through pipe 28 to tray 30 of the development system for subsequent reuse. Housing 62 is insulated to minimize amount of refrigerant required to cool water 70. Outlet pipe 80 connects housing 62 to a pump (not shown) which pumps the cooled air from chamber 64. A demister (not shown) is positioned at the entrance to outlet pipe 82 to demist the mist formed by this process. Typically, the mist has particles of about 1 micron in diameter. Particles of this size are readily demisted by the demister. A level sensor 76 is located between the inlet to pipe 28 and the inlet to pipe 78. Sensor 78 controls a valve in pipe 78 to discharge the excessive water so as to maintain the water at a substantially constant level. In this way, the inlet to pipe 28 is always located above the water level so as to receive liquid carrier. Hence, the condensed carrier vapor is discharged as a liquid from housing 62 through pipe 28 back to development tray 30 for subsequent reuse in the development system.

In recapitulation, it is clear that the carrier vapors are bubbled through a cooling fluid in which they are immiscible. As the carrier vapors pass through the cooling fluid, the vapors condense and float to the surface of the cooling fluid. The liquid carrier is then pumped back to the development tray for subsequent reuse.

It is, therefore, apparent that there has been provided, in accordance with the present invention, an apparatus for recovering vaporized carrier of the liquid developer material used in an electrophotographic printing machine that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and scope of the appended claims.

We claim:

1. An apparatus for reclaiming a developing liquid, including:

a housing defining a chamber having inlet and outlet ports with a developing liquid vapor entering the chamber through the inlet port and developing liquid exiting the chamber through the outlet port thereof; and a cooling fluid located in the chamber of said housing with the developer liquid being immiscible in said cooling fluid so that as the developer liquid vapor passes from the inlet port through said cooling fluid to the surface thereof it condenses to exit the chamber of said housing from the exit port.

2. An apparatus according to claim 1, wherein said cooling fluid is water.

3. An apparatus according to claim 2, further including means, disposed in said water, for cooling said water.

4. An apparatus according to claim 3, further including means for aerating the developer liquid vapor entering the inlet port of the chamber of said housing.

5. An apparatus according to claim 4, further including means for sensing the level of the water and controlling the discharge of water from the chamber of said housing to maintain the level of the water in the chamber of said housing intermediate the inlet port and outlet port of said housing.

6. An electrophotographic printing machine of the type in which an electrostatic latent image is recorded on a photoconductive surface, wherein the improvement includes:

means for developing the electrostatic latent image with a developing liquid in image configuration;

means for transferring the liquid image from the photoconductive surface to a copy sheet;

means for vaporizing the developing liquid to dry the copy sheet wet with developing liquid;

a housing defining a chamber having inlet and outlet ports with the developing liquid vapor entering the chamber through the inlet port and developing liquid exiting the chamber through the outlet port thereof; and a cooling fluid located in the chamber of said housing with the developer liquid being immiscible in said cooling fluid so that as the developer liquid vapor passes from the inlet port through said cooling fluid to the surface thereof it condenses to exit the chamber of said housing from the exit port.

7. A printing machine according to claim 6, wherein said cooling fluid is water.

8. A printing machine according to claim 7, means, disposed in said water, for cooling said water.

9. A printing machine according to claim 8, further including means for aerating the developer liquid vapor entering the inlet port of the chamber of said housing.

10. A printing machine according to claim 9, further including means for sensing the level of the water and controlling the discharge of water from the chamber of said housing to maintain the level of the water in the chamber of said housing intermediate the inlet port and outlet port of said housing.

11. A printing machine according to claim 6, Wherein the outlet port of said housing is in communication with said developing means to recycle the developing liquid from the chamber of said housing to said developing means for reuse.

* * * * *